US005730548A

United States Patent [19]

Brero et al.

[11] Patent Number: 5,730,548

[45] Date of Patent: Mar. 24, 1998

[54] DEADENING ROAD PAVEMENT AND METHOD FOR ITS REALIZATION

[75] Inventors: Giovanni Battista Brero, Savigliano; Antonio Ostino, Castelnuovo Don Bosco; Germano Dealessandri, Cercenasco, all of Italy

[73] Assignees: Autostrade-Concessioni E Costruzioni Autostrade S.p.A., Rome; IPSE s.r.l., Turin, both of Italy

[21] Appl. No.: 693,120

[22] PCT Filed: Feb. 11, 1994

[86] PCT No.: PCT/IT94/00011

§ 371 Date: Aug. 9, 1996

§ 102(e) Date: Aug. 9, 1996

[87] PCT Pub. No.: WO95/21964

PCT Pub. Date: Aug. 17, 1995

[51] Int. Cl.[6] ..... E01C 3/00

[52] U.S. Cl. ..... 404/27; 404/28; 404/71; 181/210; 181/286

[58] Field of Search ..... 404/17, 27, 31, 404/71, 28, 30; 181/294, 290, 286, 210, 292, 293; 428/489; 52/144

[56] References Cited

U.S. PATENT DOCUMENTS

| | | | |
|---|---|---|---|
| 3,022,712 | 10/1962 | Cousino et al. | 404/17 |
| 3,812,931 | 5/1974 | Hauskins, Jr. | 181/33 G |
| 3,870,422 | 3/1975 | Medico, Jr. | 404/31 |
| 3,983,956 | 10/1976 | Manhart | 181/33 G |
| 4,241,806 | 12/1980 | Metzger | 181/286 |
| 4,244,439 | 1/1981 | Wested | 181/210 |
| 4,562,901 | 1/1986 | Junger et al. | 181/285 |
| 4,708,516 | 11/1987 | Miller | 404/31 |
| 5,007,764 | 4/1991 | Pontynen | 404/28 X |
| 5,572,842 | 11/1996 | Stief et al. | 52/144 X |
| 5,598,669 | 2/1997 | Hamdi et al. | 52/144 |

FOREIGN PATENT DOCUMENTS

| | | | |
|---|---|---|---|
| 27 14 068 | 10/1977 | Germany | 404/31 |

*Primary Examiner*—James Lisehora
*Attorney, Agent, or Firm*—McGlew and Tuttle

[57] ABSTRACT

Deadening pavement for roads, comprising: an upper layer (10), formed by a wearing course of asphalt having an average granulometry, and a lower layer (12) supporting the wearing course (10), and which is made of cement, concrete, or similar materials, wherein in the lower layer (12) there is obtained a plurality of cavities (18), facing directly the upper layer (10),which act as Helmholtz resonators.

12 Claims, 3 Drawing Sheets

DEADENING ROAD PAVEMENT AND METHOD FOR ITS REALIZATION

TECHNICAL FIELD

The present invention relates to a method for producing a pavement (for roads) and to a method for its realization, of the type comprising an upper layer formed by a wearing course of asphalt having an average granulometry, and a lower layer made of cement, concrete or similar materials, supporting the wearing course.

BACKGROUND ART

Pavements of the type described above are already known, and they have drainage and deadening properties because of the particular granulometry of the asphalt employed.

In particular, said known pavements have high acoustic insulation coefficients in the region of high frequencies (higher than 1000 Hz).

Other conventional means for damping the noise, as for example acoustic barriers, vegetation, and special standing finish for buildings, have similar acoustic insulation properties.

On the contrary, vehicular traffic produces an acoustic source which contains in particular average and low frequencies.

Therefore, the results obtained in the reduction of noise due to vehicular traffic on roads have not been so far completely satisfactory.

DISCLOSURE OF INVENTION

In order to find a remedy for this situation, the object of the present invention is that of realizing a pavement of the type described above, characterized in that in said lower layer there is obtained a plurality of cavities facing directly the upper layer, which act as Helmholtz resonators.

From experimental tests there results that pavements according to the invention provide high acoustic insulation coefficients in the region of average-low frequencies and may therefore contribute efficaciously to the damping of noise produced by vehicular traffic.

Preferably, said cavities are filled with granulated material having an average granulometry of 3–5 cm, so as to further enlarge the spectrum of acoustic frequencies which are absorbed significantly.

A further object of the present invention is to provide a method for realizing a deadening pavement, comprising the steps of:

- disposing horizontally a plurality of box-type sections, each defining an associated internal cavity, communicating with the outside through a plurality of slots obtained on a wall of the box-type sections,
- casting a layer of concrete, cement or similar materials around said box-type sections, so as to let said slots uncovered, and
- covering said layer of cement, concrete or similar materials with an asphalt layer of average granulometry.

BRIEF DESCRIPTION OF THE DRAWINGS

Further advantages and properties of the present invention will be evident from the following detailed description, which makes reference to the annexed drawings given only for illustrative and non-limitative purposes, wherein.

BEST MODE OF CARRYING OUT THE INVENTION

Figure 1:
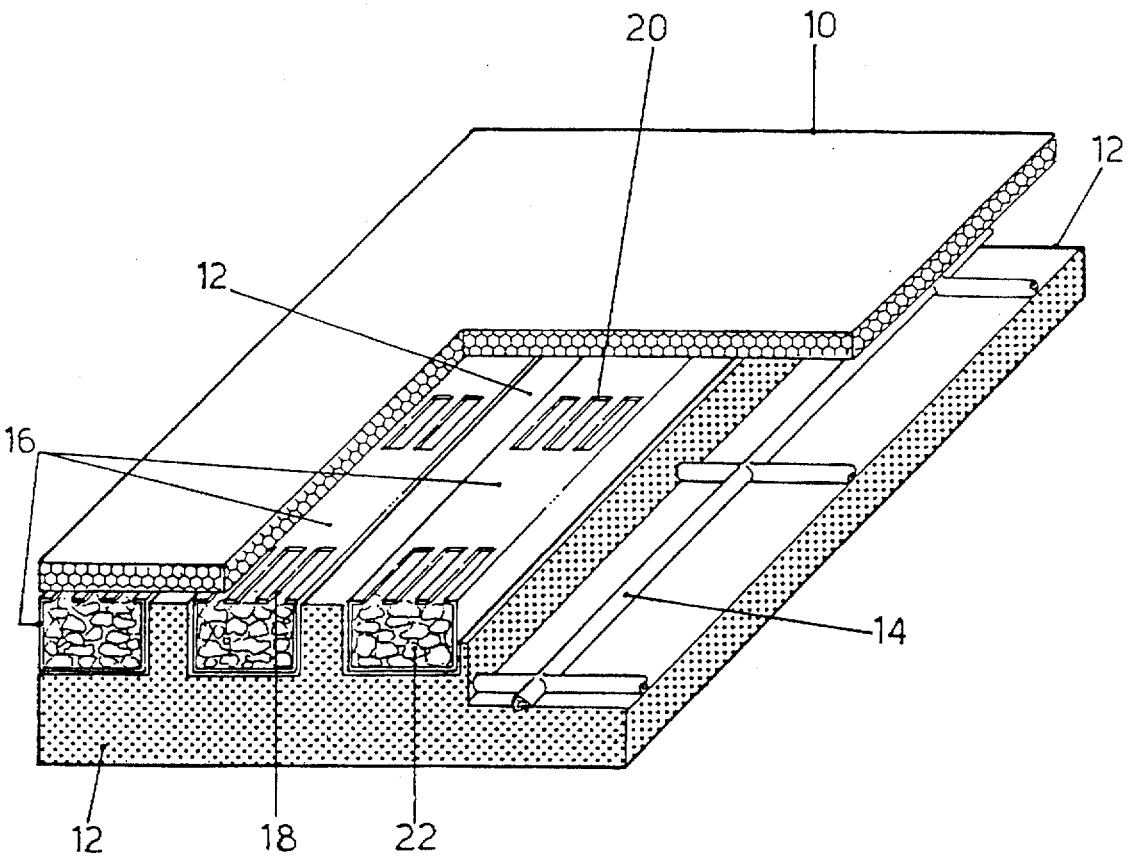
FIG. 1 is a perspective sectional view of a pavement length, according to the invention.

A pavement (for roads) (FIG. 1), comprises an upper layer 10 formed by a wearing course of asphalt with average granulometry, and a lower layer 12 supporting the wearing course, and which is made of cement, concrete or similar materials.

In the lower layer 12, there are buried a plurality of reinforcement iron bars 14 and a plurality of reinforcement box-type sections 16, which have respective internal cavities 18. These latter face directly the overlaying layer 10, in consequence of the presence of slots 20 obtained on the upper wall of the box-type sections 16. The cavities 18 are filled with granulated material 22, for example crushed stone.

A method for realizing a pavement of the above type includes a first step in which the reinforcement iron bars 14 are placed in their position, whereafter the box-type sections 16 are horizontally disposed thereon, whereby the wall on which the slots 20 are obtained, are disposed upwardly. Once the slots 20 have been closed with covering elements inserted thereon, which are not shown in FIG. 1, a layer of cement concrete, or similar material is cast around the iron bars 14 and around the box-type sections 16, taking care of letting the slots 20 uncovered.

Thereafter, the cement layer 12, which may also be a concrete layer or a layer of similar materials, is covered with a primer coat, and afterwards the covering elements are removed, whose only function was to avoid the infiltration of the primer inside the cavities 18 of the box-type sections.

At last, the layer 12 is covered with an upper layer 10 of asphalt with an average granulometry.

The layer of cement, concrete, or similar materials may be directly formed at the site where the pavement is installed, or it may be prefabricated in the form of panels which are juxtaposed when they are used.

The deadening properties of the pavement of the above described type have been verified by using a model thereof, in laboratory tests performed according to the method employing a stationary-wave-tube (Kundt tube).

Comparison tests have also been carried out, on a conventional pavement model, i.e. not provided with resonant cavities in the lower layer supporting the wearing course.

Figure 2:
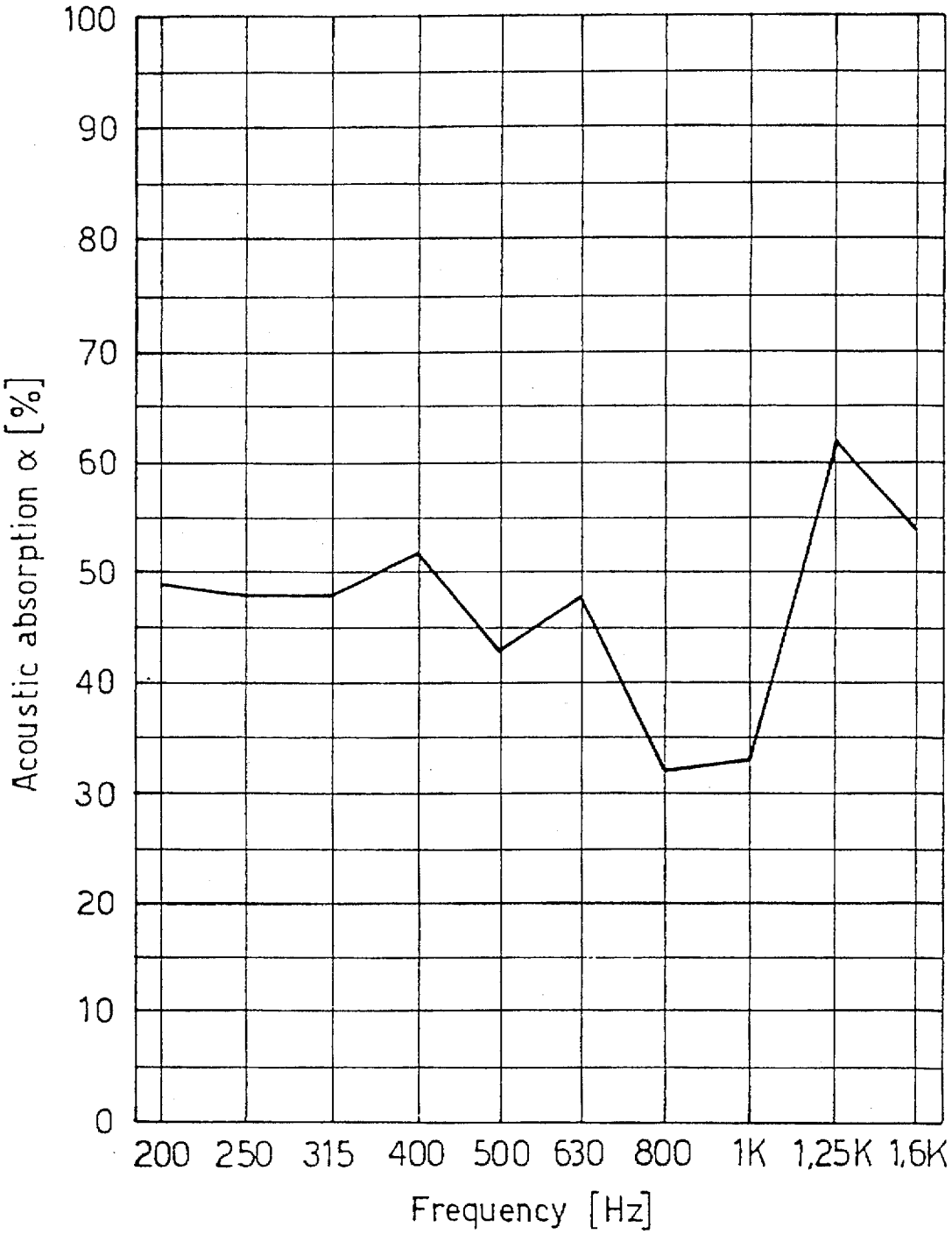
FIGS. 2 and 3 show the experimental percentage values of acoustic absorption against the frequency value, for pavement samples, according to the present invention, and conventional, respectively.
Figure 3:
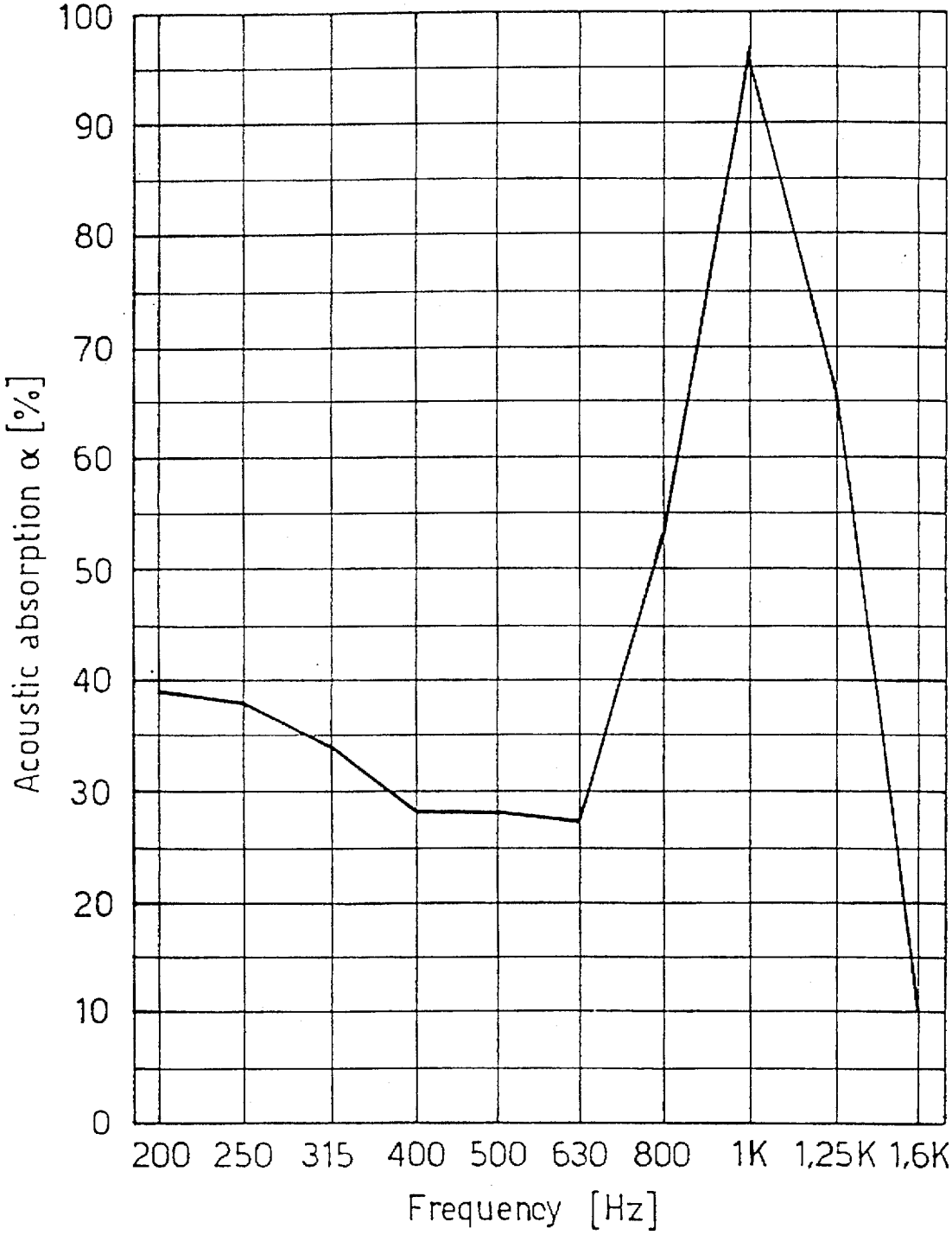

FIGS. 2 and 3 show the measured values of acoustic absorption in percentage as a function of the various frequencies, for a pavement sample of the present invention and for a conventional pavement sample respectively.

It is evident that the pavement of the invention insures the improvement of the absorption value, in particular at average-low frequencies (less than 800 Hz). This result is obtained because of the cavities of the box-type sections, which behave like the inner volume of a Helmholtz resonator, which communicates with the atmosphere in consequence of the porosity of the overlaying wearing course.

INDUSTRIAL APPLICABILITY

The filling of the cavities with crushed stone makes more uniform the acoustic absorption at different frequencies, avoiding the disadvantage of a selective absorption at a particular frequency.

Obviously, the principle of the invention remaining the same, the details of realization and the embodiments may be varied largely with respect to what has been shown and described, without departing from the scope of the present invention.

We claim:

1. Deadening pavement comprising:

an upper layer formed by a wearing course of asphalt with an average granulometry, and a lower layer supporting the upper layer, the lower layer is made of reinforced cement, concrete or similar materials, characterized in that in said lower layer there are obtained a plurality of cavities, filled with granulated material having an average granulometry 3–5 cm, directly facing the upper layer which act as Helmholtz resonators.

2. Pavement according to claim 1, characterized in that said cavities are internal cavities of box-type sections which are buried in the cement, concrete, or similar materials, and which are provided with a plurality of slots on their walls, and through which said cavities communicate with the upper layer.

3. A method for the realization of a pavement for roads characterized in that it comprises the steps of:

horizontally disposing on reinforced concrete or cement a plurality of box-type sections filled with granulated material and provided with a respective internal cavity communicating with the outside through a plurality of slots obtained on a wall of the box-type sections;

casting a layer of concrete, cement, or similar materials, around said box-type sections and leaving uncovered said slots; and covering said layer of cement, concrete, or similar materials, with a layer of asphalt with an average granulometry.

4. A method according to claim 3, comprising further the steps of closing said slots of the box-type sections by means of covering elements, before casting the layer of cement, concrete, or similar materials, coating with a primer coat the layer of cement, concrete or similar materials, and thereafter removing said covering elements before covering the layer of cement, concrete or the like with the layer of asphalt.

5. A method in accordance with claim 3, wherein:

said plurality of box-type sections are formed as Helmholtz resonators.

6. A method in accordance with claim 3, wherein:

said plurality of box-type sections are formed to absorb sounds below 800 HZ.

7. A method in accordance with claim 3, wherein:

said plurality of box-type sections are formed to absorb sounds generated by traffic on the road.

8. Pavement for traffic, the pavement comprising:

a support layer defining a plurality of cavities shaped as Helmholtz resonators for absorbing sound frequencies generated by the traffic;

granulated material in said plurality of cavities for further absorbing sound;

a wear layer formed providing a wearing surface for the traffic, being arranged on said first layer and covering said plurality of cavities.

9. Pavement in accordance with claim 8, wherein:

said plurality of cavities have an enclosed box shape with a plurality of slots in contact with said wear layer.

10. Pavement in accordance with claim 8, wherein:

said support layer is formed of structure for supporting vehicles;

said wear layer is formed of structure for resisting wear of vehicles;

said cavities are shaped to absorb sounds from vehicles.

11. Pavement in accordance with claim 8, wherein:

said cavities are shaped to absorb sounds below 800 Hz.

12. Pavement in accordance with claim 8, wherein:

said support layer is formed of one of reinforced cement, concrete, or similar materials;

said wear layer is formed of asphalt with an average granulometry;

said granulated material is of average granulometry 3–5 cm.

* * * * *